US008361238B2

(12) United States Patent
Dorton et al.

(10) Patent No.: US 8,361,238 B2
(45) Date of Patent: Jan. 29, 2013

(54) PROCESS FOR REMOVING POLYMERIC FOULING

(75) Inventors: Michael R. Dorton, Seabrook, TX (US); Gary L. Gardner, Sr., Lake Jackson, TX (US)

(73) Assignee: Perigee Solutions International, LLC, Dickenson, TX (US)

( * ) Notice: Subject to any disclaimer, the term of this patent is extended or adjusted under 35 U.S.C. 154(b) by 0 days.

(21) Appl. No.: 13/343,230

(22) Filed: Jan. 4, 2012

(65) Prior Publication Data

US 2012/0174948 A1 Jul. 12, 2012

Related U.S. Application Data

(60) Provisional application No. 61/430,401, filed on Jan. 6, 2011.

(51) Int. Cl.
*B08B 9/00* (2006.01)

(52) U.S. Cl. ..... 134/10; 134/8; 134/22.1; 134/22.14; 134/22.19; 134/26; 134/30; 134/34; 134/35; 134/36; 134/42; 510/188; 510/407; 510/432

(58) Field of Classification Search ..... 510/188, 510/407, 432; 134/8, 10, 22.1, 22.14, 22.19, 134/26, 30, 34, 35, 36, 42
See application file for complete search history.

(56) References Cited

U.S. PATENT DOCUMENTS 2,530,144 A * 11/1950 Bannon ..... 528/484
2,801,234 A * 7/1957 Hanson ..... 528/481
3,070,548 A * 12/1962 Brooke ..... 134/22.19
5,698,045 A * 12/1997 Walsh et al. ..... 134/12
6,644,326 B2 * 11/2003 Dorton et al. ..... 134/22.14

* cited by examiner

*Primary Examiner* — Bibi Carrillo
(74) *Attorney, Agent, or Firm* — McAndrews, Held & Malloy, Ltd.

(57) ABSTRACT

A process is provided for removing polymeric fouling on process equipment surfaces to restore the efficiency of such equipment. This is accomplished by contacting the fouled equipment with a solvent comprising at least one non-aromatic hydrocarbon compound, or a mixture of one or more non-aromatic organic compounds and one or more aromatic hydrocarbon compounds, for a period of time sufficient to remove the polymeric fouling.

7 Claims, 3 Drawing Sheets

PROCESS FOR REMOVING POLYMERIC FOULING

CROSS-REFERENCE TO RELATED APPLICATIONS

This application claims the benefit of provisional application 61/430,401, filed on Jan. 6, 2011.

BACKGROUND

Polymers are used in almost every product manufactured today. In polymer processing facilities where polymers are made, unwanted polymeric masses collect on the surfaces of the equipment during the polymerization process. For example, the inside surface of tube and shell heat exchangers become coated with polymeric masses. Such polymeric fouling of equipment causes a substantial loss of operational efficiency, and often such polymer-fouled equipment must be removed completely from operation.

In known methods of removing polymeric deposits, fouled equipment must be transported to a specialized facility where the polymer is burned off of the fouled surfaces in specially-constructed furnaces. Such furnace burn-out methods only clean the units transported into the furnace and not the fouled system as a whole. In such methods, the polymer-fouled equipment must be transported in and out of the plant, which occurs at considerable expense. Also adding to the time and expense of these methods are environmental and safety requirements that the polymer and equipment must be steamed to remove liquid solvents, which adhere to the contaminated surfaces or the equipment itself. After the equipment is put back into service, it is common for it to again be removed for cleaning after an average of only about four months.

In other known methods, it is attempted to remove polymer build-up mechanically with chain saws, hydro-blasting, or similar methods. Such methods are generally very costly, messy, time-consuming, and accompanied by significant safety risks. Often a film of polymer fouling will remain following use of these methods, which compromises heat transfer efficiency and promotes polymeric fouling re-seeding.

U.S. Pat. No. 6,644,326, which is incorporated by reference herein, describes a process for dissolving olefinic polymeric fouling from processing equipment using a low vapor pressure aromatic solvent, such as diphenylethane and ethylenated benzenes. A preferred solvent is Dowtherm Q (Dow® Chemical Company). This mixture is from about 50% W to about 66% W 1,1-diphenylethane and from about 34% W to about 50% W ethylenated benzenes.

DETAILED DESCRIPTION OF EMBODIMENTS OF THE INVENTION

Figure 1:
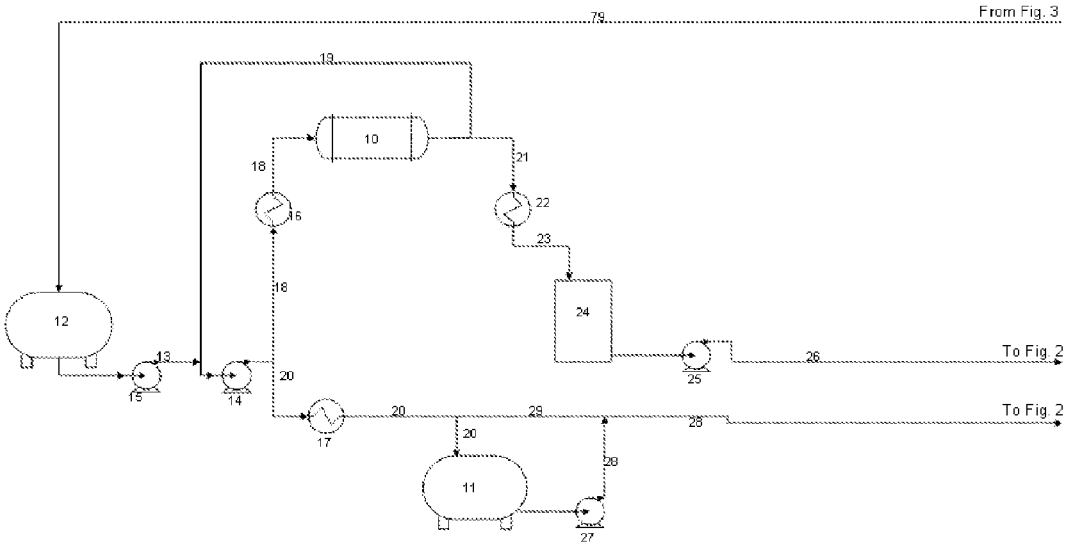
FIGS. 1, 2, and 3 are simplified schematic diagrams illustrating embodiments of the process of the present invention.
Figure 2:
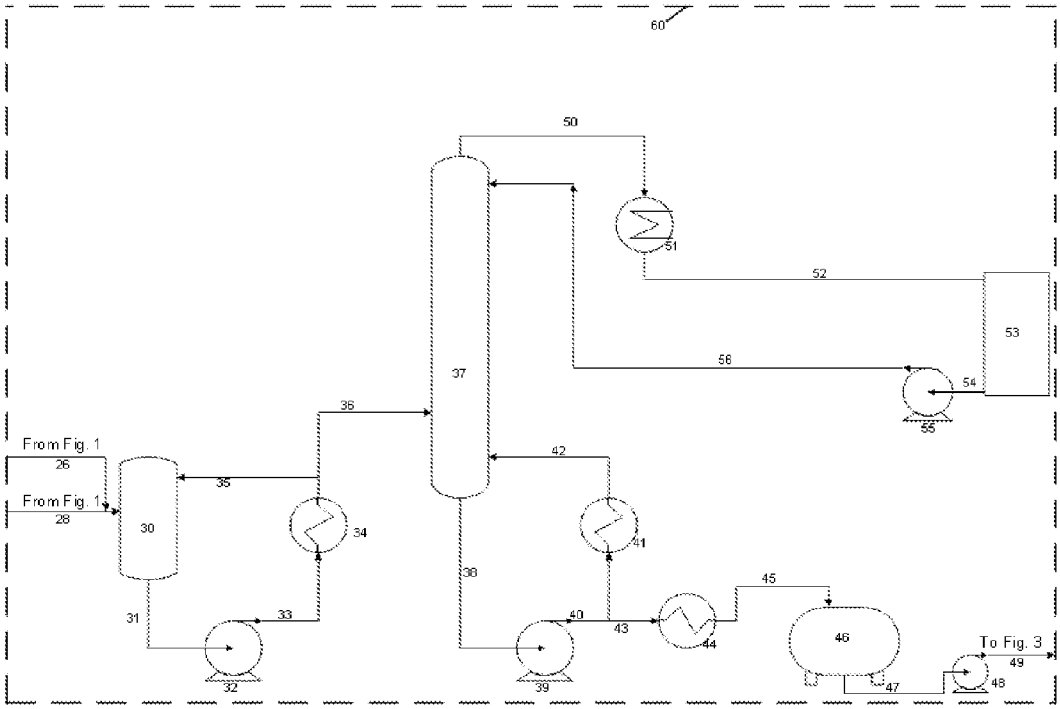

As illustrated in FIGS. 1 and 2, the practice of embodiments of the present invention involves removing built-up polymeric fouling from process equipment using chemical solvents comprised of at least one non-aromatic hydrocarbon compound or solvents comprised of mixtures of one or more non-aromatic organic compounds and one or more aromatic hydrocarbon compounds. The non-aromatic compounds are normally selected from non-aromatic hydrocarbons or other non-aromatic organic compounds having high boiling point, and low vapor pressure. The term "high boiling solvent" refers to solvents possessing a boiling point above about 300° F. "Low vapor pressure" solvent refers to solvents having a vapor pressure less than about 50 mmHg at 25° C.

Polymeric fouling build-up may be removed from equipment where polymerization occurs, often in a shell and tube bundle configuration, or other types of equipment which may be contacted by the polymer, such as reboilers, reactors, coolers, process columns, knockout drums, tanks, filters, and/or piping. Embodiments of the present invention will be described below in the context of a shell and tube exchanger, understanding that the invention is not limited thereto.

As shown in FIG. 1, the tube bundle fouled with the polymer mass is placed in a temporary stand that holds the exchanger 10 in a suitable position. The said heat exchanger may also remain in-place for insitu polymeric fouling removal as is the case for very large heat exchangers. The outer surface of the shell is preferably insulated in order to retain the heat necessary to perform the cleaning step rapidly and efficiently. As shown in FIG. 1, the circulating piping is connected to the tube side of said heat exchanger. The circulating piping may also be connected to the shell side of said heat exchanger if the polymeric fouling is on the shell side. The solvent of the present invention is taken from an appropriate storage facility or holding tank 12 and pumped into the circulating pump 14 suction line 19 via pump 15 and line 13 until the circulating system is "packed," meaning the circulating system is completely liquid full with all the air or nitrogen vented out. After the circulating system is "packed", circulation and heating is started by passing through pump 14 and heater 16 where it is heated to the temperature at which it will be used, at least about 200° F. (about 93° C.) and preferably from about 250 (about 120° C.) to about 600 (about 320° C.). The heater may either be an electric heater, direct fired heater, steam-heated shell and tube heat exchanger, or those which are well known to the skilled engineer. As the solvent is heated, it expands, increasing the pressure in the "packed" system. Automatic controls, not shown, bleeds off solvent to tank 11 by way of line 20 and cooler 17 to control the pressure in the circulating system as the solvent liquid expands. The circulating path using a large circulating pump 14 is as follows: discharge line 18, heater 16, piping 18, heat exchanger 10, and return line 19 back to circulating pump 14.

The heated solvent is then circulated through piping 18, preferably insulated, to the heat exchanger 10 containing the surfaces coated with the polymeric fouling mass. If the polymer mass is on the surfaces of the tubes or elsewhere in the processing equipment, the solvent would be routed through the fouled area. The liquid flows through the mass filling the heat exchanger 10 with the hot solvent in contact with the polymeric fouling mass. The solvent can be circulated through or held within the heat exchanger for a time sufficient to dissolve at least a portion of the polymeric fouling and then cycled out through line 20, which is cooled via cooler 17, and replaced with fresh, heated solvent.

Since the saturation level of the polymer in the high-boiling solvent has been found to normally be low (less than about 25 wt % at elevated temperatures), the circulation rate should be adjusted such that the retention time in contact with the polymer being removed is from about 5 minutes to about 20 hours, preferably from about 10 to about 30 minutes. The residence time will vary according to the ease with which a specific polymer mass is dissolved from the equipment surfaces, and as the flow rate is varied from about 350 to about 4000 gallons per minute. As the polymer is removed and flow becomes less restricted, the flow rate through the reactor may be adjusted to become either faster or slower depending on the rate of removal of the polymer mass and the level of saturation of polymer within the solvent.

The pressure within the heat exchanger 10 while being treated is normally from about 5 to about 50 psig. The temperature would normally be monitored at the lower extremity of the heat exchanger 10 containing the tube bundle being cleaned. The pressure is maintained to assure that the equipment being cleaned is kept full of heated solvent and provide a suitable net positive suction head to the intake of the pump. The solvent would normally be withdrawn from the heat exchanger containing the tube bundle through line 19 for recycle at a sufficient flow rate to maintain a linear flow velocity of at least about one foot per second resulting in sufficiently high turbulence inside the shell and around the tubes to facilitate dissolving of the polymer mass. The flow rate mentioned previously of from about 350 to about 4,000 gallons per minute has been found to be satisfactory for cleaning most equipment using the solution polymerization process and, while maintaining a particular Reynolds Number is one way of determining flow rate, the adjustment of the rate from about 350 to about 4,000 gallons per minute has been found to be satisfactory. A relatively small stream, usually from about 3 to about 6 gallons per minute, preferably about 4 gpm, is withdrawn through line 20 and collected in a tank 11 usually a portable tank such that the solvent and polymer can be removed from the customer's plant. This stream may also go directly to a solvent recovery system via lines 28 and 29 so that polymer loaded solvent is continuously taken out of the system and is replaced with fresh or recovered solvent through recycle lines 79. When operated as a continuous process including solvent recovery, the smaller stream may vary substantially from the above amounts.

It is preferable that the output of the pump 14 or heater 16 have a manifold (not shown) which would allow the direction of flow to be reversed so that the solvent could be directed to flow in either direction in the heat exchanger in order to assure complete cleaning of the polymer from the equipment. It has been found that flow in both directions improves removal of the polymer fouling.

Figure 3:
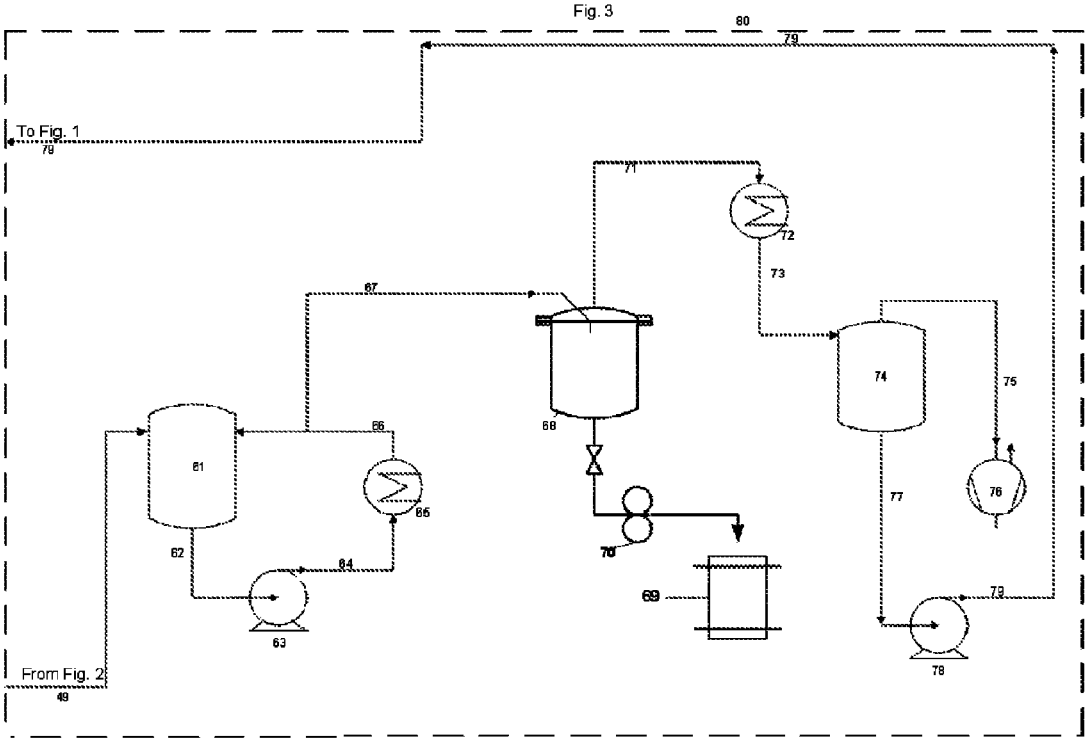

The embodiment of FIG. 3 also shows a preferred, simplified solvent recovery and recycle system integrated into the removal system for taking the polymeric fouling from the reactor. Alternatively, in an embodiment of the present invention, the solvent containing the polymer could merely be collected in a container such as the 550 gallon tote tank mentioned above and then, using the tank as a feed, separate the polymeric fouling mass from the high boiling, low vapor pressure solvent at a central facility or some other location. When this step of circulation is used, it is not necessary to hold the solvent within the vessel being cleaned. Here the solvent would heat and remove polymer continuously through the contact with it. It would be necessary, however, to monitor the concentration of polymer within the solvent so that saturation levels of the solvent not be seriously approached since complications could arise concerning solvent recovery. However, as is discussed hereafter concerning the solvent recovery system and embodiment of this invention, the concentration of polymer would be controlled through the recovery. It is not necessary for the practice of embodiments of the present invention that all polymeric fouling removed from the equipment be removed from the solvent on each pass, only that the concentration of the polymer within the solvent remain safely below the saturation level which varies with the temperature of the solvent being used. The same screening test run to determine the suitability of the solvent can also be used to approximate the solubility of the polymer in the solvent. The solvent containing the dissolved polymeric fouling may also be removed from the equipment on a batch basis and held in portable containers for subsequent processing for solvent recovery. When batch removal is practiced, fresh solvent would be pumped into the heat exchanger 10 to dissolve additional polymer and the steps would be repeated until the equipment is cleaned.

As an embodiment to be operated on a continuous-circulation basis, the bleed line 20 from exit pipe 19 of the heat exchanger 10 would be connected to the feed drum 30 in the process solvent recovery system 60 and processed as described above. The polymer laden solvent mixture is pumped out of storage vessel 46 via line 47 through pump 48 and line 49 into the feed drum 61 in the recovery system 80 for the high boiling solvent used in practice of cleaning the reactor. The contents of feed drum 61 is maintained at an elevated temperature of from about 450° F. (about 230° C.) to about 575° F. (about 300° C.), preferably from about 495° F. (about 260° C.) to about 550° F. (about 290° C.), by circulating the contents through a heater 65 with lines 62, 64 and 66 and pump 63. A smaller stream is taken off line 66 via line 67 and injected into flash drum 68. The temperature of the solvent containing the polymeric fouling is elevated sufficiently to cause an adiabatic flash of the solvent in this mixture upon introduction into drum 68 at reduced absolute pressure. Preferably it is maintained at a vacuum of from about 28 to about 29.9 inches of mercury. The solvent flashes to form a vapor, leaving the flash drum 68 through line 71. The polymer remains in the flash drum 68 in a molten state. As the level of molten polymer builds up in the flash drum 68, it is pumped into suitable disposal containers, such as an open-top drum 69 via a suitable pump 70. The solvent recovery procedure may be varied according to the solvent selected. Such adjustments are within the ability of the skilled engineer.

The polymer and solvent solution is sprayed into the flash drum 68 from line 67. The line 67 is fitted with a suitable spray nozzle on the end where it sprays into the flash drum 68.

The solvent leaves as a vapor through line 71 and condenser 72, through line 73 and thence into a collection drum 74 from which it can flow to pump 78 via line 77 and then be pumped back to the storage tank 12 (FIG. 1) through line 79. The condenser 72 is preferably water-cooled, shell and tube heat exchanger with water flowing through the tubes. The use of the storage tank 12 allows flexibility in the amount of recycle so that the rate can be increased or decreased as needed during the practice of embodiments of the present invention to remove the polymer fouling. The flash drum 68, the condenser 72, the collection drum 74 and all of the interconnecting piping is maintained at a medium vacuum with a vacuum pump 76 connected to the system with line 75. Since heat losses in and around the flash drum 68 are unavoidable, electric strip heaters are preferably attached to the outside of the flash drum 68 shell and it is heavily insulated. Other methods of maintaining the temperature are also appropriate. When used, these electric strip heaters are controlled with surface mounted thermostats set on about 425° F. (about 220° C.), depending upon the solvent and polymer combination. These heaters also are advantageous for boiling the solvent out of the flash drum 68 after the feed to the flash drum 68 has been terminated. Some solvent may collect in the flash drum 68 if, for example, process solvent has diluted the oil in vacuum pump 76 and as a result the vacuum has not been sufficient to flash off all of the solvent during a recovery run.

The chemical mixtures described in accordance with embodiments of the present invention broadly include blends, mixtures, solutions, and other types of chemical combinations known to a person skilled in the art or produced as custom solvents as required by the customer. Solvents suitable for use in accordance with embodiments of the present invention comprise mixtures of one or more low vapor pressure aromatic hydrocarbons and one or more non-aromatic organic compounds. Other solvents suitable for use in accordance with embodiments of the present invention comprise one or more non-aromatic hydrocarbons. Suitable non-aromatic organic compounds and non-aromatic hydrocarbons are normally selected from those having high boiling point, low vapor pressure, and suitable industrial hygiene properties, including, but not limited to, light and medium crude oil distillates such as paraffins, isoparaffins, kerosene, diesel fuel, and/or other petroleum-derived fuel oils; alcohols such as ethylene glycol; napthenes such as decalin and/or Isopar M® (ExxonMobil®); n-methyl-2-pyrrolidone; olefinic hydrocarbons such as d-limonene; ethers such as dimethyldiphenyl, dipropylene glycol methyl ether and/or dipropylene glycol butyl ether; organic acids such as carboxylic acids; and mixtures thereof. Suitable aromatic hydrocarbons include, but are not limited to diphenylethane, ethylenated benzenes, tetralin, naphthalene, trichloroberizene, alkyl phenyl compounds, alkyl benzyl aromatics, diphenyls, diphenyl ethers, diphenyl alkyls, alkyl substituted diphenyl alkyls, and mixtures thereof. Another characteristic which is desirable, but not required, is a tack of corrosiveness of the solvent in the presence of common metals and alloys at temperatures which approach the boiling point of the solvent. A preferred solvent for the practice of embodiments of the present invention comprises a mixture of about 50% V diphenylethane and ethylenated benzene (HT-Solve® 515, Perigee® Engineering Services) and about 50% V diesel fuel.

It is generally known that fuel oils such as kerosene and diesel fuel are composed of about 75% V saturated hydrocarbons (primarily paraffins including n, iso, and cycloparaffins), and about 25% V aromatic hydrocarbons (including napthatenes and alkybenzenes). Kerosene typically consists of hydrocarbons in the $C_9$ to $C_{16}$ range. From the American Petroleum Institute, a typical analysis of kerosene (fuel oil no. 1) is:

| Hydrocarbon Type | Volume % |
|---|---|
| Paraffins (n- and iso-) | 52.4 |
| Monocycloparaffins | 21.3 |
| Bicycloparaffins | 5.1 |
| Tricycloparaffins | 0.8 |
| Total Saturated Paraffins | 79.7 |
| Alkybenzenes | 13.5 |
| Indans/Tetralins | 3.3 |
| Dinapthenobenzenes/Indenes | 0.9 |
| Napthalenes | 2.8 |
| Biphenyls/Acenaphthenes | 0.4 |
| Total Aromatic Hydrocarbons | 23.6 |

Diesel fuel is a mixture of carbon chains that typically contain between 8 and 21 carbon atoms per molecule. The typical chemical formula for common diesel fuel is $C_{12}H_{23}$, but commonly ranges from approximately $C_{10}H_{20}$ to $C_{15}H_{28}$. From the American Petroleum Institute, a typical analysis of diesel fuel (fuel oil no. 2) is:

| Hydrocarbon Type | Volume % |
|---|---|
| Paraffins (n- and iso-) | 41.3 |
| Monocycloparaffins | 22.1 |
| Bicycloparaffins | 9.6 |
| Tricycloparaffins | 2.3 |
| Total Saturated Paraffins | 75.3 |
| Alkybenzenes | 5.9 |
| Indans/Tetralins | 4.1 |
| Dinapthenobenzenes/Indenes | 1.8 |
| Napthalenes | 8.2 |
| Biphenyls/Acenaphthenes | 2.6 |
| Fluorenes/Acenapthylenes | 1.4 |
| Phenanthrenes | 0.7 |
| Total Aromatic Hydrocarbons | 24.7 |

It is generally known that the vapor pressure of kerosene (no. 1) and diesel fuel (no. 2) ranges from 2.12 to 26.4 mm Hg at 21.0 C, according to 1989 U.S. Air Force specifications. The vapor pressure of the solvent Dowtherm Q is 0.002 mm Hg at 25.0° C. from Dow Chemical Company data. The vapor pressure of a 50% blended solvent according to embodiments of the present invention, for example, could range from about 1 mm Hg to about 15 mm Hg at ambient temperature. The flash point of Dowtherm Q is 249° F. (about 120° C.) and the typical minimum flash point of No. 2 diesel is 136° F. (about 60° C.), according to 1985 US Coast Guard specifications.

In polymer processing facilities, polymeric coating masses collect on the surfaces of the equipment. For example, if the fouled equipment is a shell and tube device, it would accumulate on the heat exchanger-type tubes and the inside surface of the shell containing the tubes causing a loss of operational efficiency. Of course, the build-up could occur inside the tubes of a reactor when the polymerization reaction takes place on the tube side. The practice of the cleaning process of embodiments of the present invention can be practiced wherever the polymeric fouling mass accumulates.

Polymers are often prepared in reaction systems whereby an olefin or non-olefin monomer is catalytically polymerized in a low boiling hydrocarbon solvent. The polymerization occurs in a reactor which is either cooled or heated by indirect heat exchange, often in a shell and tube bundle configuration. In the shell and tube configuration, the reaction can occur either on the tube side or the shell side of the equipment and the use of the cleaning process of embodiments of the present invention is applicable to either configuration. It is also applicable to other types of equipment which may be contacted by the polymer either during or after polymerization reaction occurs. Some polymerizations occur in stirred reactors or a series of continuous stirred reactors thus the polymer build up may be on virtually any surface which comes into contact with the polymer. The inside of pipes may be fouled by the polymer such that the clean up process of embodiments of the present invention may be applicable. When the term process equipment is used, it could apply to any of the vessels which are contacted by polymer fouling, including, but not limited to, reboilers, reactors, coolers, process columns, knockout drums, tanks, and/or filters.

Embodiments of the present invention may be used to remove many different types of polymeric fouling. Non-vinyl polymers and copolymers particularly adapted for removal in the practice of embodiments of the present invention include, but are not limited to, polyethers and polysulfides, such as poly (ethylene oxide), poly (ethylene glycol), poly (acetaldehyde), and poly (formaldehyde); polyesters, such as polycarbonates; polyamides, such as polycaprolactam (nylon 6), poly (11-urtdecanoamide) (nylon 11), and polyurethanes; and phenol-, urea-, and melamine-formaldehyde polymers, such as phenolic resins. Vinyl polymers and copolymers particularly adapted for removal in the practice of embodiments of the present invention include, but are not limited to, polyethylene, polypropylene, polyvinylchloride, ethylene-propylene copolymers, polybutyldiene, polystyrene, ethylene-propylene rubber copolymer EPM, poly acrylic acid, and ethylene-propylene rubber terpolymers of EPDM, polypentadiene, polyisoprene and styrene-butydiene isoprene terpolymers, terpolymers such as SBR rubbers and SBS rubbers, Occasionally, however, as a result of the polymerization reactions taking place inside the equipment, the undesired polymer masses that accumulate may be mixed, copolymerized, and crosslinked in such a way as to not be specifically identifiable, but can still be dissolved in accordance with embodiments of the present invention. A laboratory test of heating a sample of the polymer or copolymer in a beaker or flask containing a solvent mixture of embodiments of the present invention can be used to select the solvent and determine the appropriate temperature as well as the solubility of the polymeric fouling in the solvent.

The versatility of the process of this invention is manifest in the diversity with which the process can be practiced to service the particular needs of the customer. The equipment is sufficiently compact to be skid-mounted and carried by truck to the chemical plant where the polymer is being produced. On the plant site, through the use of a suitable frame or rack to hold the equipment, the fouled process equipment, if a shell and tube reactor or heat exchanger, can be positioned either vertically or horizontally, shell and tubes, such that a circulation unit can be connected to perform the process. It will be recognized by those skilled in the art that the orientation of the equipment will depend on many factors such as draining ability, accessibility, lifting capabilities and net positive suction head requirements for pumps used to circulate the fluid. It is also possible, and preferable, with appropriate piping, to establish a cycle, or loop, for circulating heated solvent through the reactor without removing the reactor from the operating facility, being appropriately blanked from the rest of the process. Yet another way in which the cleaning process of embodiments of the present invention may be practiced is at a facility off the plant site to which the reactor can be transported and then placed in a frame holding the shell of a shell and tube reactor system for cleaning by contacting the polymer mass with the high-boiling, low vapor pressure solvent for cleaning.

It is preferred for the embodiment involving circulation of the solvent to continue circulation until the solvent approaches being saturated with polymer. Once the equipment is full of solvent, circulation through the equipment is carried out at flow rates specific for the equipment being cleaned. Flow rates are calculated to result in linear flow velocity of at least about 1 foot per second. The flow rate will normally vary from about 75 to about 4000 gpm, preferably from about 100 to about 1700 gpm.

Those skilled in the art are versed in the design and operation of a flash drum to separate materials having different levels of volatility and therefore understand the application of a combination of temperature and pressure. In the practice of embodiments of the present invention, it is a matter of engineering choice based on a balancing of cost dictated in part by the solvent being used and the polymeric material being removed with this solvent. Thus, it can be seen by the foregoing description that the process of embodiments of the present invention provides wide latitude with respect to its operation to remove the polymer residues from equipment surfaces, particularly the tube bundles forming the indirect heat transfer surfaces within a reactor.

It has been found that embodiments of the present invention that use solvents comprising at least one non-aromatic hydrocarbon compound, or solvents comprising mixtures of one or more non-aromatic organic compounds and one or more aromatic hydrocarbon compounds, are advantageous. These solvents, when used in conjunction with embodiments of the present invention, have been found to dissolve a wide range of polymeric fouling compositions effectively at a wide range of temperatures, pressures, and other varied environmental conditions, which significantly affects versatility, time required, and ease of use. Moreover, the cost to the user is substantially reduced when these solvents are used with embodiments of the present invention, making them particularly advantageous.

The foregoing description of embodiments of the present invention will be further demonstrated and explained through the following examples, which are for purposes of exemplification and not limitation of the invention described herein.

EXAMPLE 1

A solvent comprising a mixture of about 50% V Dowtherm Q and about 50% V No. 2 diesel fuel was mixed for testing in the lab. A benchmark polyethylene sample was used as the polymer to be dissolved. The polyethylene was introduced into 200 ml of the solvent to comprise 5% W of polymer in solution in a 500 ml flask. The mixture was heated on a temperature-controlled hot plate while stirring with a magnetic stirring bar. The temperature set point was raised to 350° F. (180° C.), the setting known to dissolve this polymer with Dowtherm Q. When this temperature was reached inside the flask, all of the polymer had been dissolved.

EXAMPLE 2

A large reboiler was fouled on the tube side in a large chemical plant. Due to the tough polymeric fouling and number of tubes, cleaning of this reboiler would have usually required a cleaning period of 4 to 6 months using high-pressure water blasting. Based on the previous lab results using a solvent comprising a mixture of about 50% V Dowtherm Q and about 50% V No. 2 diesel fuel, this mixture was proposed to dissolve the polymeric fouling in this reboiler. This solvent was circulated for two days through the reboiler at temperatures of 350° F. (about 180° C.), in a quantity of 8,000 gallons, in conjunction with the process of an embodiment of the present invention. Upon inspection of the treated reboiler surfaces, the polymeric fouling was effectively dissolved.

EXAMPLE 3

Polymeric fouling was removed from EVA high pressure coolers in a large chemical plant using a solvent comprising a mixture of about 50% V HT-Solve® 709 and about 50% V kerosene (HT-Solve® 789, Perigee® Engineering Services). The cleaning solvent was pumped into the equipment at ambient temperature using a skid-mounted pump and circulation system. The solution was circulated at 200° F. (about 90° C.) for about 10 hours to dissolve the polymeric fouling. Pressure was maintained at 35 psig by bleeding off excess pressure from expanding fluid through a control valve into a vacuum truck. The solvent was then cooled to 140° F. (about 60° C.) (below the flash point), and circulation was turned off. The solvent and dissolved polymer mixture was then drained and pumped into a vacuum truck. Upon inspection of the treated surfaces, it was found that substantially all of the polymeric fouling was effectively removed.

EXAMPLE 4

A solvent comprising a mixture of about 29% V HT-Solve® 709 and about 71% V diesel fuel (HT-Solver® 759, Perigee® Engineering Services) was mixed for testing in the lab. A benchmark sample of polymeric fouling comprising high density polyethylene from a large commercial reactor was used as the polymer to be dissolved. The polyethylene was introduced into 200 ml of the solvent to comprise 5% W of polymer in solution in a 500 ml flask. The temperature set point was set at 375° F. (about 190° C.) in the temperature-controlled flask on a stirred hot plate. After about 2 hours, all the solid polymer appeared to be dissolved. The solution was then strained into another flask through a fine stainless steel mesh screen. Only a small amount of solid polymer was retained on the screen (0.50 g of solid polymer saturated with solvent).

EXAMPLE 5

Polymeric fouling was removed from a tank in a large chemical plant using a solvent comprising a mixture of about 38% V solvent naptha (petroleum), about 38% V heavy aromatic naptha, and about 25% V citrus terpenes (HT-Solve® 148, Perigee® Engineering Services). About 2,500 gallons of the cleaning solvent was initially pumped into the equipment at ambient temperature, and then heated via a heat exchanger. Temperatures ranged from 115° F. (about 46® C. to 134° F. (about 57° C.). The cleaning progressed as spent solvent and material were constantly removed and more fresh solvent was added. Throughout the cleaning process, progress was gauged by running a pipe into the annulus to gauge the thickness of the material remaining in the tank. It was found that the fouling material was comprised of distinct layers of semi viscous liquid and very dense taffy-like material. The thin material went into solution readily, but the thick sticky material required increased contact time with the solvent. In total, the solvent was circulated for about 10 days, and a total of about 25,000 gallons of solvent was used. Upon inspection of the treated tank, it was found that substantially all of the polymeric fouling was effectively removed.

EXAMPLE 6

A solvent comprising isoparaffin (Isopar M®, ExxonMobil®) was mixed for testing in the lab. A benchmark sample of polymeric fouling comprising ethyl vinyl acetate from a large commercial cooler was used as the polymer to be dissolved. The sample was introduced into 100 ml of the solvent in solution in a 250 ml flask. The temperature set point was set at about 250° F. (about 120° C.) in the temperature-controlled flask on a stirred hot plate using a reflux condenser. After about 3 hours, most of the visible solid polymer appeared to be dissolved. After cooling, a milky-white solution remained in the flask.

EXAMPLE 7

A solvent comprising about 50% V isoparaffin (Isopar M®, ExxonMobil®) and about 50% V diesel fuel was mixed for testing in the lab. A benchmark sample of polymeric fouling comprising high density polyethylene from a large commercial reactor was used as the polymer to be dissolved. The sample was introduced into 100 ml of the solvent in solution in a 250 ml flask. The temperature set point was set at about 250° F. (about 120° C.) in the temperature-controlled flask on a stirred hot plate using a reflux condenser. After about 3 hours, most of the visible solid polymer appeared to be dissolved. After cooling, a milky-white solution remained in the flask.

EXAMPLE 8

A solvent comprising about 28% V trichlorobenzene, about 28% V diesel fuel, about 28% V isoparaffin (Isopar M®, ExxonMobil®), and about 16% V tetralin was mixed for testing in the lab. A benchmark sample of polymeric fouling comprising ultra high molecular weight polyethylene from a large commercial reactor was used as the polymer to be dissolved. The sample was introduced into the solvent in a 250 ml flask at a temperature of about 320° F. (about 160° C.). After about 10 hours, most of the solid polymeric fouling sample appeared to be dissolved.

What is claimed is:

1. A process for removing polymeric fouling on process equipment surfaces comprising the steps of:

contacting polymeric fouling on one or more process equipment surfaces with a solvent capable of dissolving the polymeric fouling, the solvent comprising naptha and citrus terpenes; and maintaining contact of the polymeric fouling with the solvent at a temperature of from about 115° F. (about 50° C.) to about 600° F. (about 320° C.) for a time sufficient to dissolve and remove at least a portion of the polymeric fouling.

2. The process of claim 1 wherein the solvent comprises from about 10% volume to about 50% volume of said naptha and from about 10% volume to about 50% volume of said citrus terpenes.

3. The process of claim 1 including the additional steps of:

recovering the solvent containing dissolved polymeric fouling;

recovering the polymeric fouling from the solvent;

recycling the recovered solvent to a process equipment surface having polymeric fouling.

4. The process of claim 1 wherein the polymeric fouling on at least one process equipment surface occurred during a monomer polymerization process.

5. The process of claim 1 wherein the polymeric fouling comprises non-vinyl polymers or copolymers.

6. The process of claim 1 wherein the polymeric fouling comprises polyethylene or polypropylene polymers or copolymers.

7. The process of claim 1 wherein at least 50% of the polymeric fouling is removed from the process equipment surface.

* * * * *